US006622712B2

(12) United States Patent
Nakashima et al.

(10) Patent No.: US 6,622,712 B2
(45) Date of Patent: Sep. 23, 2003

(54) RESIN-INSULATED IGNITION COIL

(75) Inventors: Hidetoshi Nakashima, Chiryu (JP); Kazutoyo Osuka, Gamagori (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/341,256

(22) Filed: Jan. 14, 2003

(65) Prior Publication Data

US 2003/0136391 A1 Jul. 24, 2003

(30) Foreign Application Priority Data

Jan. 18, 2002 (JP) ..... 2002-010359
Nov. 18, 2002 (JP) ..... 2002-334156

(51) Int. Cl.[7] ..... F02P 3/00

(52) U.S. Cl. ..... 123/634; 336/96

(58) Field of Search ..... 123/634; 336/96

(56) References Cited

U.S. PATENT DOCUMENTS 6,561,173 B2 * 5/2003 Betz et al. ..... 336/96
6,571,784 B2 * 6/2003 Shimada et al. ..... 123/634

FOREIGN PATENT DOCUMENTS

JP 2000-182859 6/2000

* cited by examiner

*Primary Examiner*—Erick Solis
(74) *Attorney, Agent, or Firm*—Nixon & Vanderhye P.C.

(57) ABSTRACT

An ignition coil includes a center core, a primary coil a secondary coil, a coil housing, a tower housing disposed under the coil housing, and a high tension terminal disposed inside the tower housing. The high tension terminal has an upper flange disposed at a first circumferential gap opposite the inside surface of the tower housing and a middle barrel disposed at a second circumferential gap opposite the inside surface of the coil housing. The first circumferential gap is made smaller than the second circumferential gap. The tower housing or the upper flange has a void-purging passage for purging air from the insulation resinous members when filled in the coil housing.

6 Claims, 7 Drawing Sheets

RESIN-INSULATED IGNITION COIL

CROSS REFERENCE TO RELATED APPLICATION

The present application is based on and claims priority from Japanese Patent Applications 2002-10359, filed Jan. 18, 2002, and 2002-334156, filed Nov. 18, 2002, the contents of which are incorporated herein by reference.

BACKGROUND OF THE INVENTION

1. Field of the Invention

The present invention relates to an ignition coil for a vehicle and, particularly, a stick-type resin-insulated ignition coil to be mounted in each plug hole of a vehicle engine.

2. Description of the Related Art

JP-A-2000-182859 discloses a stick-type ignition coil that includes a coil housing and a tower housing. The coil housing accommodates a center core, a primary coil and a secondary coil, and the tower housing accommodates a high-tension terminal. Insulation epoxy resin is filled in the coil housing and the tower housing to insulate the accommodated members from each other.

As shown in FIG. 8, a high tension terminal 101 of a known ignition coil 100 is a bullet-like metal member. The tower housing 104 is a cylindrical member made of resin. The high tension terminal 101 is disposed in the tower housing 104 to be coaxial therewith. The high tension terminal 101 has an upper flange 102 and a middle barrel 103. There is a comparatively small circumferential gap 105 between the inside surface of the tower housing 104 and the outer periphery of the upper flange 102. The high tension terminal 101 is held by a cylindrical guide 79 to be coaxial with the tower housing 104, so that a projection 75 can be inserted into the lower end of a spool easily when assembled. There is a comparatively large circumferential gap 106 between the outer periphery of the middle barrel 103 and the inside surface of the tower housing 104. Although the circumferential gap 105 around the high tension terminal 101 is comparatively small, liquid state epoxy resin is poured through the circumferential gap 105 into the space formed between the middle barrel and the tower housing 104. Thereafter, the epoxy resin is solidified in the smaller circumferential gap 105 and the larger circumferential gap 106.

Because the high tension terminal 101 is made of metal while the tower housing 104 is made of resin, the coefficient of thermal expansion of the high tension terminal 101 is much different from that of the tower housing 104. The temperature of the ignition coil 100 increases when it is operated and decreases after it is stopped. Therefore, the high tension terminal 101 and the tower housing 104 are heated and cooled cyclically. Accordingly, the epoxy resin disposed in the circumferential gaps 105, 106 is subjected to thermal stress.

As shown in FIG. 8, the high tension terminal 101 has the middle barrel 103 that has a smaller outside diameter than the upper flange in order to elongate the mean distance between the high tension terminal 101 and the inside surface of a plug hole (indicated by 91 in FIG. 7) formed in an engine. This structure reduces stray capacitance between the high tension terminal and the plug hole to increase the high tension voltage. However, voids 107 may be formed in the epoxy resin disposed in the gap 106 when liquid state epoxy resin is poured into the large gap 106 through the small gap 105. If there are voids 107 in the epoxy resin disposed between the high tension terminal 101 and the tower housing 104, insulation performance of the ignition coil lowers, and the ignition coil may not supply sufficient high tension voltage to a spark plug.

SUMMARY OF THE INVENTION

Therefore, an object of the present invention is to provide a reliable ignition coil in which voids are not formed in the insulation resin disposed between the tower housing and the high tension terminal.

According to a feature of the invention, an ignition coil includes a center core with primary and secondary coils wound around, a cylindrical coil housing, a cylindrical tower housing having an upper flange and a middle barrel disposed under the coil housing, a high tension terminal connected to the secondary coil and solid insulation resinous members that are solidified after being filled in the coil housing and the tower housing. In the above ignition coil, at least the tower housing or the upper flange has a void-purging passage for purging air from the insulation resinous members when filled in the coil housing and the tower housing.

When liquid state insulation resin is poured from the upper end of the coil housing into- the inside of the coil housing and the tower housing, air can be purged from the circumferential gap and the void-purging passage.

Preferably the void-purging passage is vertically formed in the upper flange. The void-purging passage may be a groove disposed on the inside surface of the tower housing. The high tension terminal may be molded in the tower housing so as to eliminate a chance to form voids around the high tension terminal.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

An ignition coil according to the first embodiment of the invention will be described with reference to FIGS. 1–3 and FIG. 7.

Figure 1:
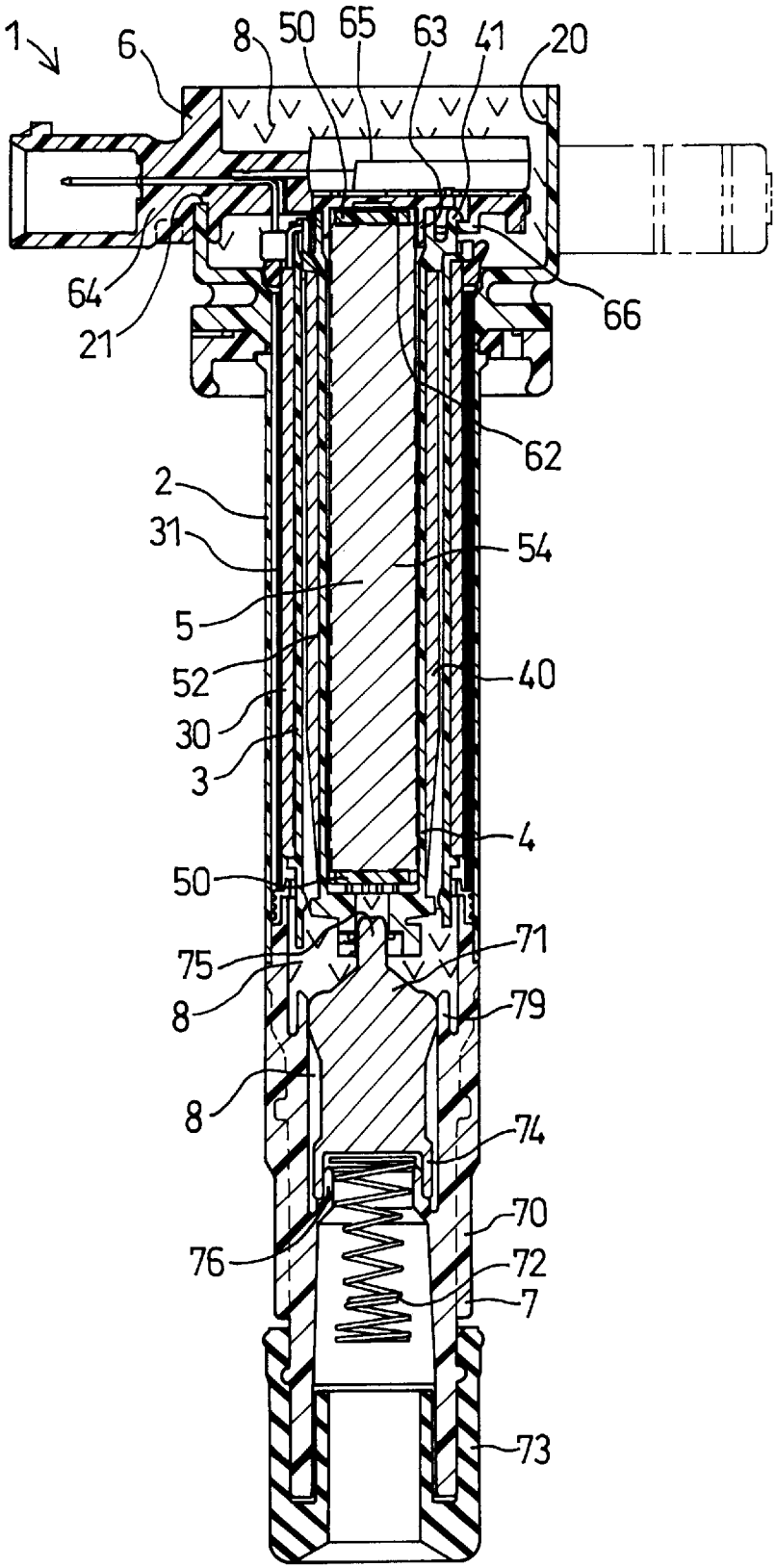
FIG. 1 is a cross-sectional side view of an ignition coil according to the first embodiment of the invention.
Figure 7:
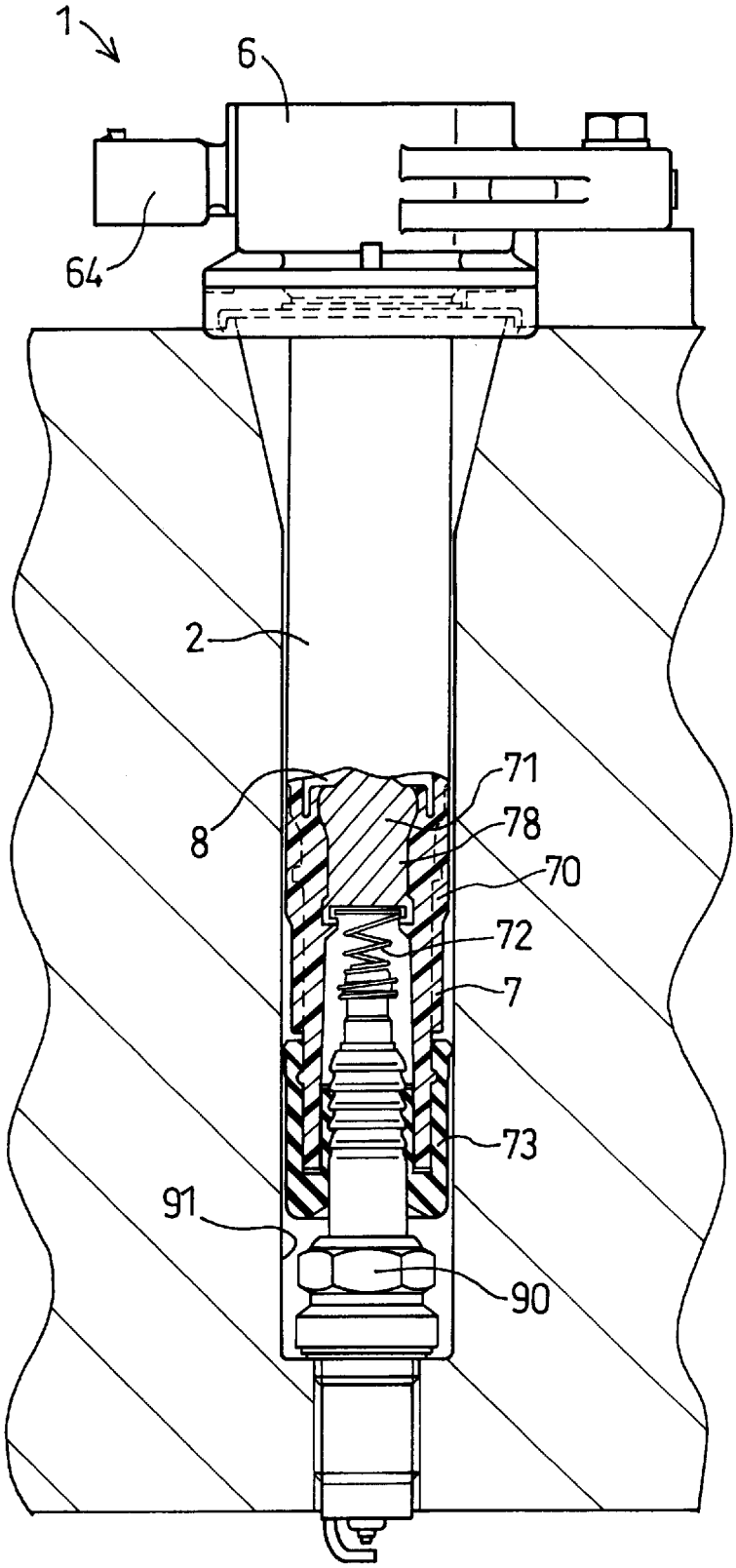
FIG. 7 is a cross-sectional view illustrating the ignition coil according to the fourth embodiment of the invention together with an ignition spark plug mounted in a plug hole of an engine.
Figure 8:
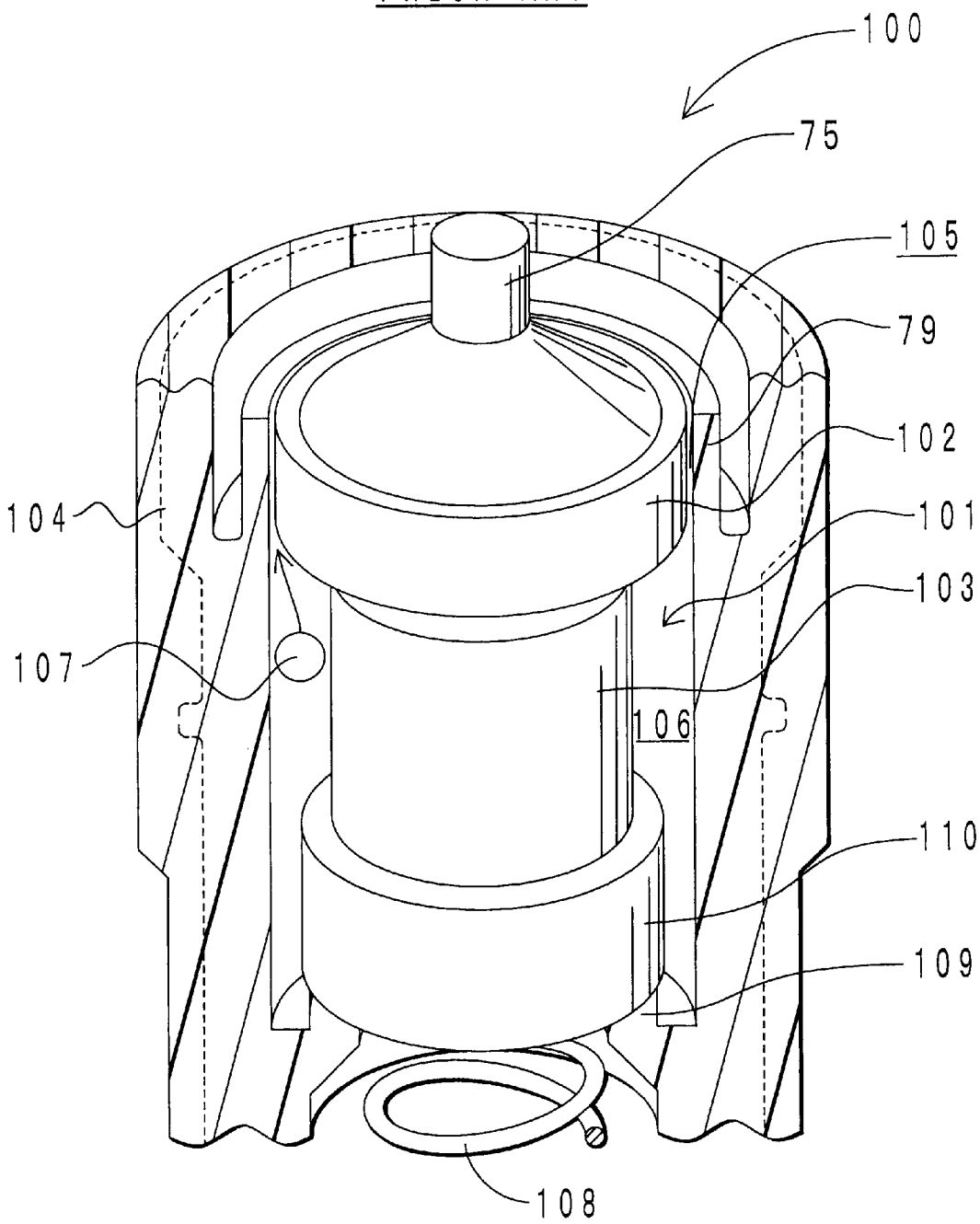
FIG. 8 PRIOR ART
FIG. 8 is a fragmentary enlarged perspective view illustrating a main portion of a prior art ignition coil.

As shown in FIG. 1, the ignition coil 1 is mounted in a plug hole 91 disposed at an upper portion of an engine, as shown in FIG. 7. The ignition coil 1 has a resinous cylindrical coil housing 2. The coil housing 2 has a wide-open upper end 20 that has a cut 21. A center core section 5, a primary spool 3 that holds a primary coil 30 and a secondary spool that holds a secondary coil 40 are housed in the coil housing 2.

The center core section 5 is comprised of a center core 54, a pair of columnar elastic members 50 and a rubber tube 52. The center core 54 is a pole-shaped pile of a plurality of oblong-card shape silicon steel sheets. The elastic members 50 are made of silicon rubber and disposed at upper and lower ends of the center core 54. The center core 54 and the elastic members 50 are covered by the rubber tube 52.

The secondary spool 4 has a flange and a bottom portion. The secondary spool 4 is disposed around the center core 5 to be coaxial therewith. The secondary coil 40 is wound around the secondary spool 4. Three spool-side hooks 41 are formed at the upper end of the secondary spool 4 at equal intervals to upwardly extend from the upper end.

The primary spool 3 is disposed around the secondary spool 4 to be coaxial therewith. The primary coil 30 is wound around the primary spool 3. A cylindrical external core 31 that has a plurality of longitudinal slits is disposed around the primary spool 3.

A connector section 6 is disposed at the wide-open upper end 20 of the coil housing 2. The connector section 6 is comprised of an input-signal connector 64 and an igniter 65. The input-signal connector 64 has a rectangular pipe made of resinous material that extends in a radially outward direction from the cut 21 of the wide-open upper end 20.

The igniter 65 has a parallelepiped member made of resinous material, which is disposed at the center of the wide-open upper end 20 and is integrated with the inside end of the input-signal connector 64. The igniter 65 has a bottom 62 from which a cylindrical positioning wall 63 extending downwardly. The positioning wall 63 is disposed between the elastic member 50 of the center core section 5 and the inside surface of the secondary spool 4 so as to position the center core 5 and the secondary spool 4 in the coil housing 2. The bottom 62 of the igniter 65 also has three downwardly extending igniter-side hooks 66 around the positioning wall 63 at equal intervals, so that the igniter-side hooks 66 and the spool-side hooks engage each other to fix the connector section 6 and the secondary spool 4 together.

A high tension tower section 7 is disposed under the coil housing 2. The high tension tower 7 is comprised of a tower housing 70, a high tension terminal 71, a coil spring 72 and a rubber-made plug cap 73.

The tower housing 70 is a resinous cylindrical member and has an inside surface whose inside diameter becomes stepwise smaller at the lower portion thereof than the upper portion. A cylindrical terminal guide 79 extends upwardly from the upper stepped portion of the inside surface. The terminal guide 79 has a terminal support cylinder 76 at the lower end thereof.

The high tension terminal 71 is a bullet-shaped metal member. A columnar projection 75 is formed at the center of the high tension terminal 71 to upwardly project and to be inserted into the lower end opening of the secondary spool 4. A cylindrical wall 74 downwardly extends from the circumference of the lower end of the high tension terminal 71, and the terminal support cylinder 76 is force-fitted into the cylindrical wall. Because the high tension terminal 71 is guided by the terminal guide 79, it is easy to insert the projection 75 into the secondary spool 4.

The upper end of the coil spring 72 is fixed to the inside of the cylindrical wall 74 of the high tension terminal 71, and the lower end is to be inserted a spark plug. The plug cap 73 covers the lower end of the tower housing 70 so as to elastically hold the spark plug.

Solidified epoxy resin 8 is filled in spaces formed between various components and portions of the ignition coil that are disposed inside the coil housing 2 and the tower housing 70. The solidified epoxy resin 8 is formed from liquid-state epoxy resin, which is a mixture of epoxy prepolymer and a hardening agent. The mixture is poured from the wide-open upper end 20 into the coil housing 2 and the tower housing under a vacuum pressure. The epoxy resin 8 connects various components and portions of the ignition coil and insulates those from each other.

A control signal is transmitted from the input-signal connector 64 to the primary coil 30 via the igniter 65, so that a high tension voltage is, induced in the secondary coil 40. The high tension voltage is supplied from the secondary coil 40 to a spark plug via the high tension terminal 71 and the coil spring 72, so that an electric spark is generated across the spark gap of the spark plug.

Figure 2:
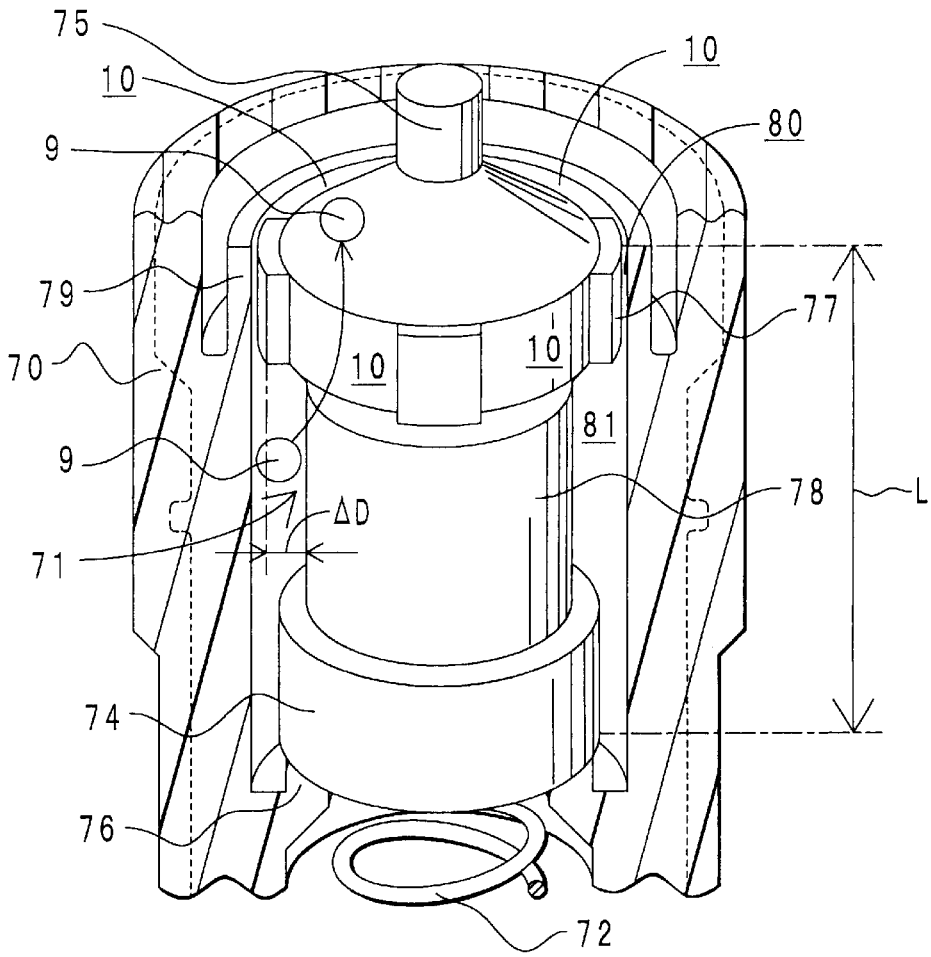
FIG. 2 is a fragmentary enlarged perspective view illustrating a main portion of the ignition coil shown in FIG. 1.

As shown in FIG. 2, the high tension terminal 71 has an upper flange 77 that has a comparatively large outside diameter and a middle barrel 78 that has a smaller outside diameter than the upper flange. A first circumferential gap 80 that has a comparatively short distance is formed between the upper flange 71 and the cylindrical guide 79, and a second circumferential gap 81 that has a longer distance than the first circumferential gap 80 is formed between the middle barrel 78 and the tower housing 70. The upper flange 77 has four void-purging grooves that are formed on the outer periphery thereof to space apart at equal intervals from each other in the circumferential direction. Therefore, the upper flange 77 is shaped like a gear. The void-purging grooves 10 extend in the vertical direction to connect the inside of the coil housing 2 and the second circumferential gap 81 and in the radial direction to connect the first circumferential gap 80.

When a mixture of the epoxy prepolymer and hardening agent is poured into the coil housing 2, it flows down along the inner surface of the coil housing 2 through the first circumferential gap 80 and the void-purging grooves 10 into the second circumferential gap 81. Because the void-purging grooves 10 provide a sufficient space to purge air from the mixture, as indicated by an arrow in FIG. 2.

Figure 3:
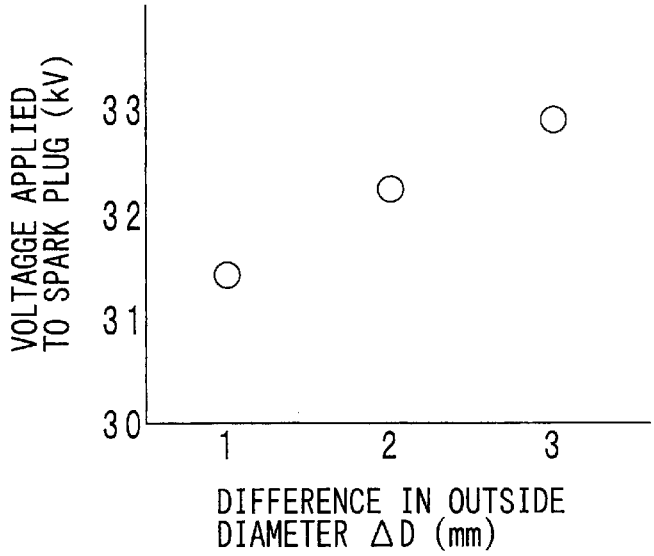
FIG. 3 is a graph showing a relationship between voltage levels of high tension voltage applied to the ignition coil and differences in outside diameter between the upper flange and the middle barrel.

As shown in FIG. 3, the high tension voltage to be applied to a spark plug can be increased as a difference $\Delta D$ in outside diameter between the upper flange 77 and the middle barrel 78 increases. It has been found that the difference $\Delta D$ is preferably 1 mm or more if the total length L of the high tension terminal 71 (the distance between the upper end of the upper flange 77 and the lower end of the cylindrical wall 74) is 15 mm or longer. In other words, the high tension voltage can be increased as the outside diameter of the middle barrel 78 becomes smaller and the distance between the middle barrel 78 and the inside surface of the plug hole 91 increases.

An ignition coil according to the second embodiment of the invention is described with reference to FIG. 4. Incidentally, the same reference numeral indicates the same or substantially the same portion or component as the ignition coil according to the first embodiment.

Four spiral void-purging grooves 10 are formed on the upper flange 77. Accordingly, air can be purged from the mixture of the epoxy prepolymer and the hardening agent in the same manner as described above.

An ignition coil according to the third embodiment of the invention is described with reference to FIG. 5.

Four vertical void-purging grooves 11 are formed on the inside surface of the terminal guide 79 of the tower housing 70 at portions thereof opposite the upper flange 77. Accordingly, the cross-section of the grooves can be increased so that air can be more easily purged from the mixture of the epoxy prepolymer and the hardening agent in the same manner as described above.

Figure 6:
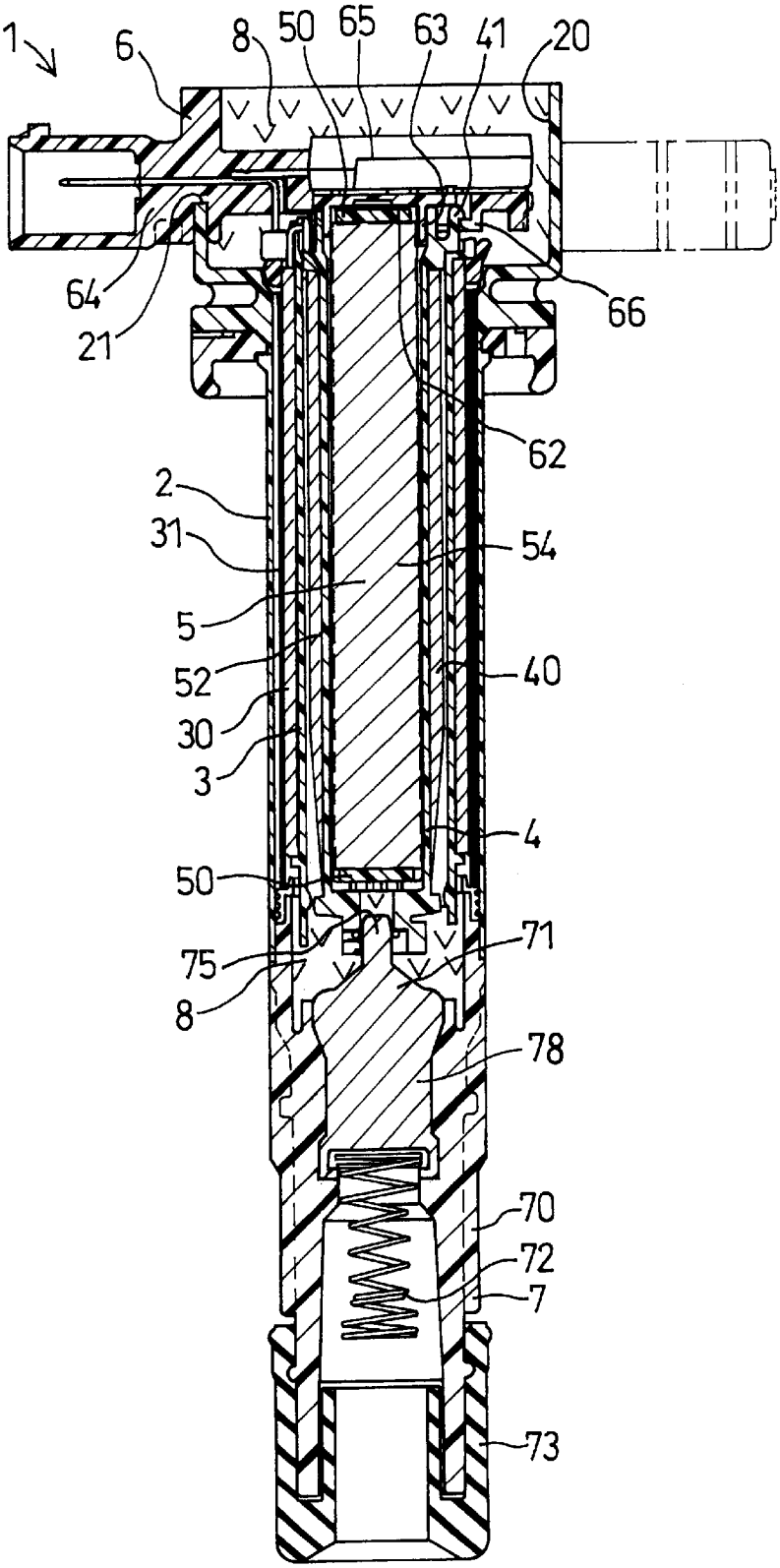
FIG. 6 is a cross-sectional side view of an ignition coil according to the fourth embodiment of the invention.

An ignition coil according to the fourth embodiment of the invention is described with reference to FIGS. 6–7.

The high tension terminal 71 is insert-molded into the tower housing 70, so that the periphery of the middle barrel 78 is in contact with the inside surface of the tower housing 70. Accordingly, there is little chance to form voids around the high tension terminal 71. As a result, the high tension terminal 71 and the tower housing 70 are not damaged by thermal stress, and insulation of the high tension terminal 71 can be secured.

Figure 4:
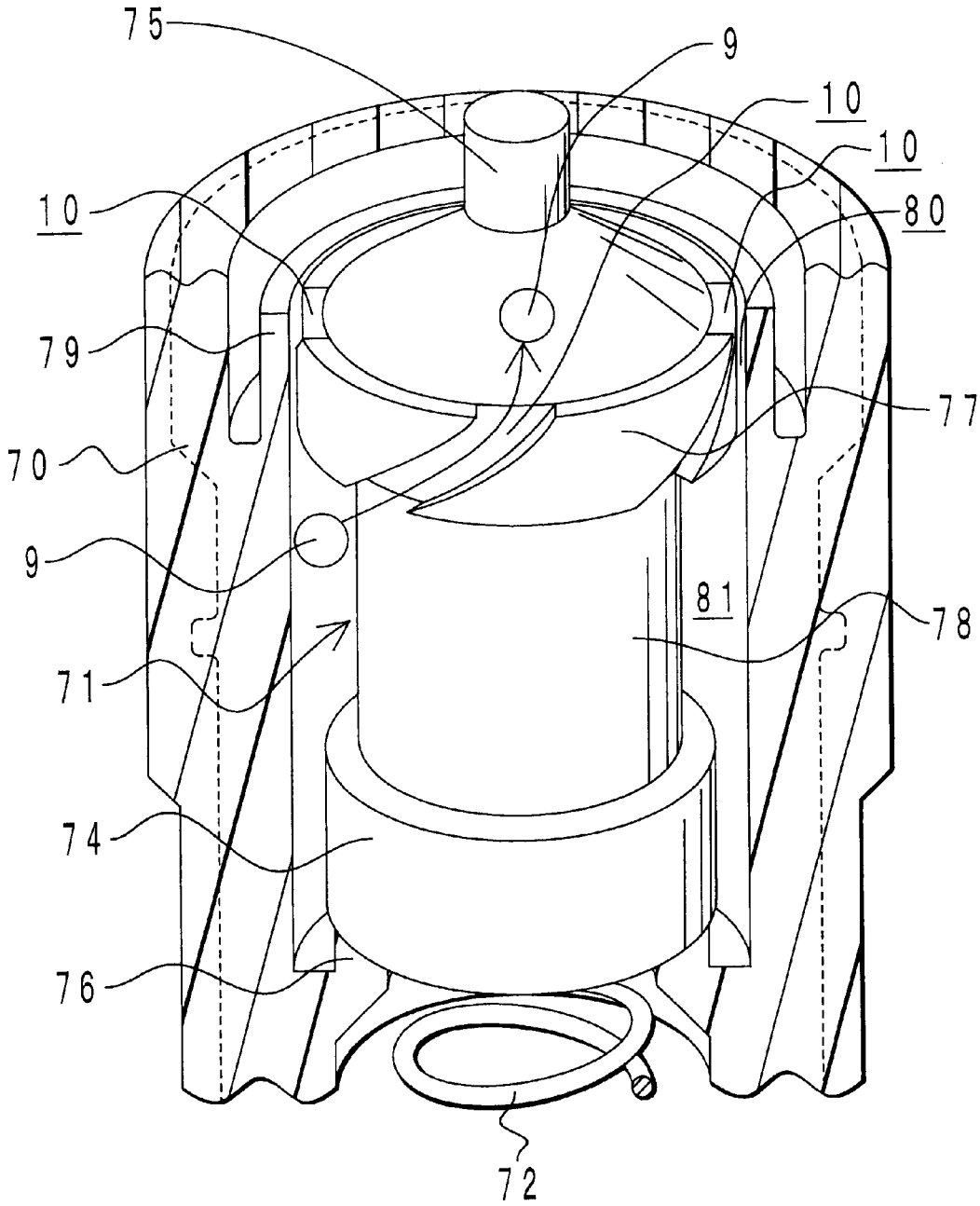
FIG. 4 is a fragmentary enlarged perspective view illustrating a main portion of an ignition coil according to the second embodiment of the invention.
Figure 5:
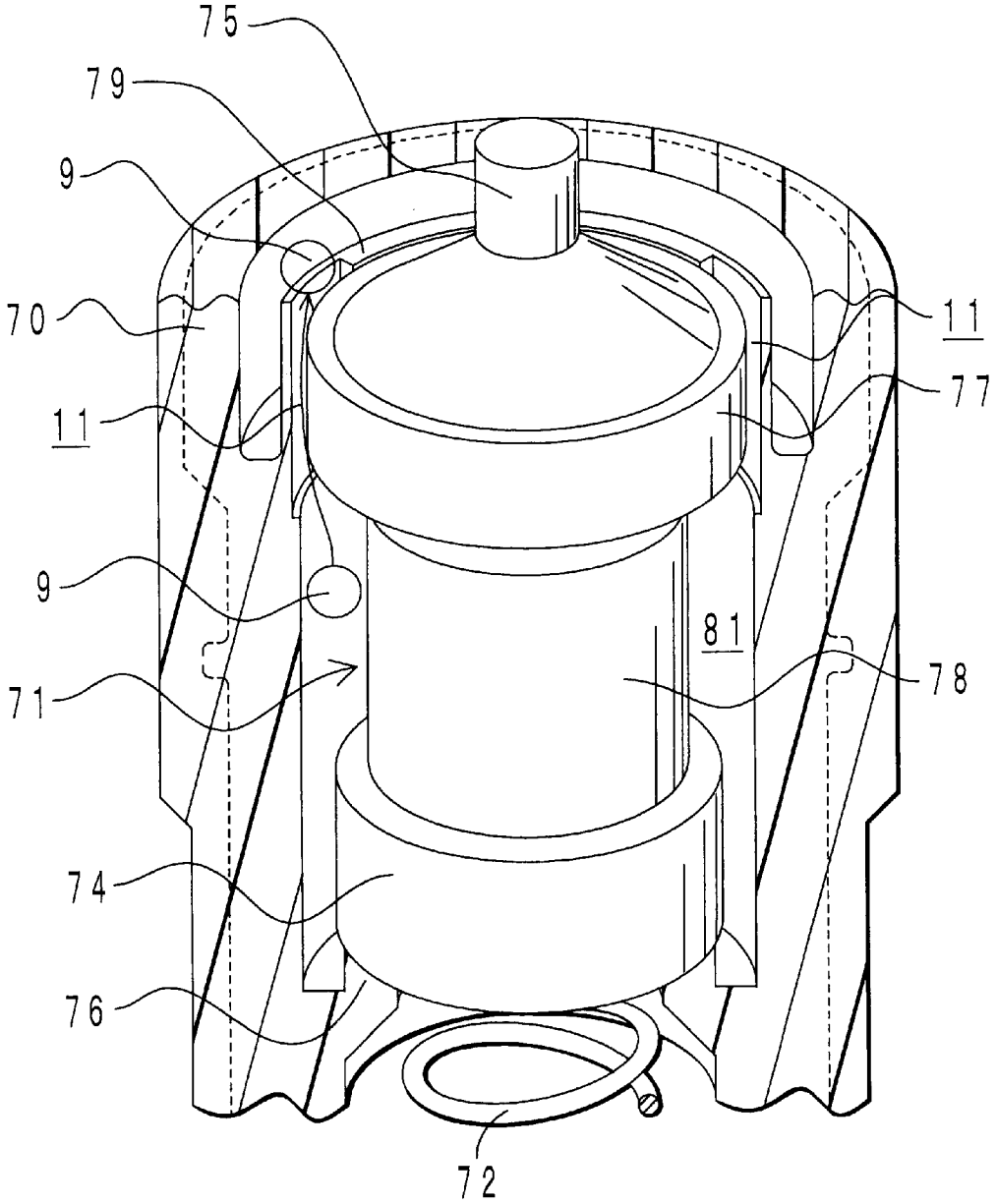
FIG. 5 a fragmentary enlarged perspective view illustrating a main portion of the ignition coil according to the third embodiment of the invention.

As a variation of the ignition coil described above, a plurality of the void-purging grooves can be formed both on the outer periphery of the high tension terminal 71, as shown in FIGS. 2 and 4, and on the inner surface of the tower housing 70, as shown in FIG. 5.

In the foregoing description of the present invention, the invention has been disclosed with reference to specific embodiments thereof It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An ignition coil comprising:

a center core;

a pair of a primary coil and a secondary coil wound around said center core;

a cylindrical coil housing for holding said center core and said pair of primary and secondary coils;

a cylindrical tower housing disposed under said coil housing;

a high tension terminal disposed inside said tower housing and connected to said secondary coil, said high tension terminal having an upper flange disposed at a first circumferential gap opposite the inside surface of said tower housing and a middle barrel disposed at a second circumferential gap opposite the inside surface of said coil housing, said first circumferential gap being smaller than said second circumferential gap; and solid insulation resinous members that are solidified after being filled in said coil housing and said tower housing;

wherein at least one of said tower housing and said upper flange has a void-purging passage for purging air from said insulation resinous members when filled in said coil housing and said tower housing.

2. The ignition coil as claimed in claim 1, wherein said void-purging passage vertically penetrates said upper flange.

3. The ignition coil as claimed in claim 1, wherein said void-purging passage is a groove disposed on the inside surface of said tower housing.

4. An ignition coil comprising:

a center core;

a pair of a primary coil and a secondary coil wound around said center core;

a cylindrical coil housing for holding said center core and said pair of primary and secondary coils;

a cylindrical tower housing disposed under said coil housing;

a high tension terminal disposed inside said tower housing and connected to said secondary coil, said high tension terminal having an upper flange disposed and a middle barrel disposed under said upper flange, said upper flange being larger than said middle barrel; and solid insulation resinous members that are solidified after being filled in said coil housing and said tower housing;

wherein said high tension terminal is molded in said tower housing.

5. An ignition coil comprising:

an igniter having an input-signal connector;

a coil section disposed under said igniter, said coil section including a center core, a primary coil connected to said igniter, a secondary coil and a cylindrical coil housing for holding said center core and said pair of primary and secondary coils;

a cylindrical tower housing disposed under said coil housing, said tower housing having a cylindrical guide;

a high tension terminal disposed inside said tower housing and connected to said secondary coil, said high tension terminal having an upper flange disposed opposite said cylindrical guide to be guided thereby when assembled and a middle barrel disposed opposite the inside surface of said coil housing to reduce stray capacitance formed when mounted in an engine, and solid insulation resinous members that are solidified after being filled in said coil housing and said tower housing;

wherein a void-purging passage is formed in a space between said tower housing and said upper flange to purge air from said insulation resinous members when said insulation resinous member before solidified is filled in said coil housing and said tower housing.

6. An ignition coil comprising:

a coil section disposed under said igniter, said coil section including a center core, a primary coil, a secondary coil and a cylindrical coil housing for holding said center core and said pair of primary and secondary coils;

a cylindrical tower housing disposed under said coil housing;

a high tension terminal disposed inside said tower housing and connected to said secondary coil, and solid insulation resinous members that are solidified after being filled in said coil housing and said tower housing;

wherein said high tension terminal has a void-purging passage on the outer periphery thereof to purge air from said insulation resinous members when said insulation resinous member before solidified is filled in said coil housing and said tower housing.

* * * * *